United States Patent [19]

Arentsen

[11] 4,367,800

[45] Jan. 11, 1983

[54] SUBSEA PILE DRIVER

[75] Inventor: Dirk Arentsen, Leiderdorp, Netherlands

[73] Assignee: Hollandsche Beton Groep N.V., Rijswijk, Netherlands

[21] Appl. No.: 124,701

[22] Filed: Feb. 26, 1980

[51] Int. Cl.[3] ..... E02D 7/02; E02D 7/06

[52] U.S. Cl. ..... 173/127; 405/228; 173/DIG. 1

[58] Field of Search ..... 173/DIG. 1, 127; 405/228; 175/6

[56] References Cited

U.S. PATENT DOCUMENTS

| | | | |
|---|---|---|---|
| 1,846,804 | 2/1932 | Hansen | 175/6 X |
| 3,547,207 | 12/1970 | Warrington | 173/DIG. 1 |
| 3,800,548 | 4/1974 | Wisotsky | 405/228 |
| 3,820,346 | 6/1974 | Wisotsky | 405/228 |
| 3,970,156 | 7/1976 | Niskin | 173/DIG. 1 |
| 4,033,139 | 7/1977 | Frederick | 173/DIG. 1 |
| 4,043,405 | 8/1977 | Kuhn . | |
| 4,238,166 | 12/1980 | Gendron | 173/DIG. 1 |

FOREIGN PATENT DOCUMENTS

| | | | |
|---|---|---|---|
| 647404 | 2/1979 | U.S.S.R. | 173/DIG. 1 |

*Primary Examiner*—Werner H. Schroeder
*Assistant Examiner*—Andrew M. Falik
*Attorney, Agent, or Firm*—Brisebois & Kruger

[57] ABSTRACT

The hammer of an underwater pile driving apparatus is movable upwards and downwards in a housing which, in operation, is filled with a liquid which is present both above and below the hammer, the hammer being driven at least on the upwards direction by a driving liquid which is pressurized by a motor driven pump located on or adjacent the housing and which is the same as the liquid in which the hammer moves.

8 Claims, 11 Drawing Figures

SUBSEA PILE DRIVER

BACKGROUND OF THE INVENTION

1. Field of the Invention

This invention relates to pile-driving apparatus for use in underwater pile-driving, and comprising a hammer unit in which the hammer or ram is moved downwards and upwards in a housing to deliver an impact to the pile through an opening in the bottom of the housing and in which the hammer is driven, at least in the upwards direction, by means of a pressurized driving liquid. The driving system may be single-acting in which the hammer is driven upwards by the driving liquid and then falls by gravity as a dropweight to deliver the impact force to the pile, or double-acting in which the hammer acts as a ram and is driven both upwards and then downwards by the pressurized driving liquid.

2. Description of the Prior Art

In the art of underwater pile-driving, the housing is closed and filled with air under suitable compression to act as a kind of diving bell so that the hammer can move in air and not in water. One such construction is described in British Pat. No. 1,388,690. The drive unit comprising motor-driven, positive-displacement type pumps and associated accumulators for pressurizing the driving liquid, usually oil, can be located above the water, e.g. on a ship as described in DOS No. 2,243,309. As the depth of pile-driving increases, pressure losses occur in the supply hoses and these pressure losses can theoretically be compensated for at greater depth; a depth of 300 meters is the present practical limit for pressurized liquid hoses, which are also very expensive.

Proposals have therefore been made to reduce the lengths of the supply hoses by locating the driving unit comprising the motor-driven pumps and associated accumulators on the hoisting frame of the hammer unit or other member which is so connected to the housing that it may move over a limited distance relative to the housing and, in some cases, is provided with buoyancy tanks (see U.S. Pat. No. 4,043,405).

SUMMARY OF THE INVENTION

Situations are now occurring where underwater pile-driving is being required up to much greater depths, even to 2 kilometers, and the present invention has for its object to provide underwater pile-driving apparatus which alleviates the problems of pile-driving at great depths.

Contrary to the present practice and belief that, for underwater pile-driving, the hammer should move in a gaseous atmosphere, namely air, and that every effort has been made to maintain that atmosphere during operation by supplying compressed air to the housing and/or avoiding any leakage of liquid into the housing, the present invention is based on the discovery that pile-driving can be effectively and efficiently carried out if the hammer moves in a liquid. The invention makes use of this discovery by filling the housing in which the hammer moves with a liquid which is normally at the pressure of the ambient water at the depth at which the hammer unit is operating. The substantial equalization of pressures outside and inside the housing overcomes the problem of having to provide an exceptionally strong and heavy housing which is capable of withstanding the very high pressures experienced at great depths. Further the invention employs the same liquid as that in which the hammer moves as the driving liquid which is pressurized by a motor-driven pump located on or adjacent the housing, thereby overcoming the problems of supply hoses and of providing a separate tank or reservoir for the oil or other driving liquid required for driving the hammer. The invention thus provides a pile-driving apparatus which is capable of operating at great depth and avoids in a simple manner the difficulties and complications in the use of existing underwater pile-driving apparatus.

The invention thus consists in underwater pile-driving apparatus in which a hammer is movable upwards and downwards in a housing to deliver an impact to the pile through an opening in the bottom of the housing and in which the hammer is driven at least in the upward direction by means of a pressurized liquid, characterized in that the housing, in which the hammer moves is, during operation, filled with a liquid which is present above and below the hammer and is normally at the pressure of the ambient water, and in that the driving liquid is the same as the liquid in which the hammer moves and is pressurized by a motor-driven pump located on or adjacent the housing.

Conveniently the liquid with which the housing is filled is the ambient water in which the apparatus is submerged. The driving liquid to be pressurized is initially at the pressure of the ambient water and a feature of the invention consists in using a centrifugal or other non-positive displacement pump or pumps for pressurizing the liquid. Such pump, while not producing such a high pressure as positive displacement pumps, produce a high volume delivery, do not require the use of accumulators, and are not likely to become damaged or choked by muddy sea water.

In cases where the ambient water is particularly muddy or otherwise unsuitable for use in the apparatus, the liquid in which the hammer moves may be enclosed by the housing, the pump being in communication with the housing through a closed circuit system, pressure and volume compensating means being provided between the liquid in the housing and the ambient water to render the pressure of the liquid in the housing substantially the same as that of the ambient water. With such constructions, the liquid may be water or oil. Suitable anti-corrosive additives may be added to the liquid.

As the hammer is immersed in the driving liquid a further feature of the invention consists in using the hammer itself as the piston of the driving system, operating in a single-acting, double-acting or differential fashion by delivery of the pressurized liquid to the appropriate end of the housing.

The automatic pressure compensation achieved by the invention is of extreme importance where the hammer unit has to be used at great depths, for example two kilometers, where an ambient pressure of 200 bars exist. There is no need for gas under such high pressures. cl

BRIEF DESCRIPTION OF THE DRAWINGS

In the drawings the same reference characters are used to designate the same or similar parts.

DESCRIPTION OF PREFERRED EMBODIMENTS

Figure 1:
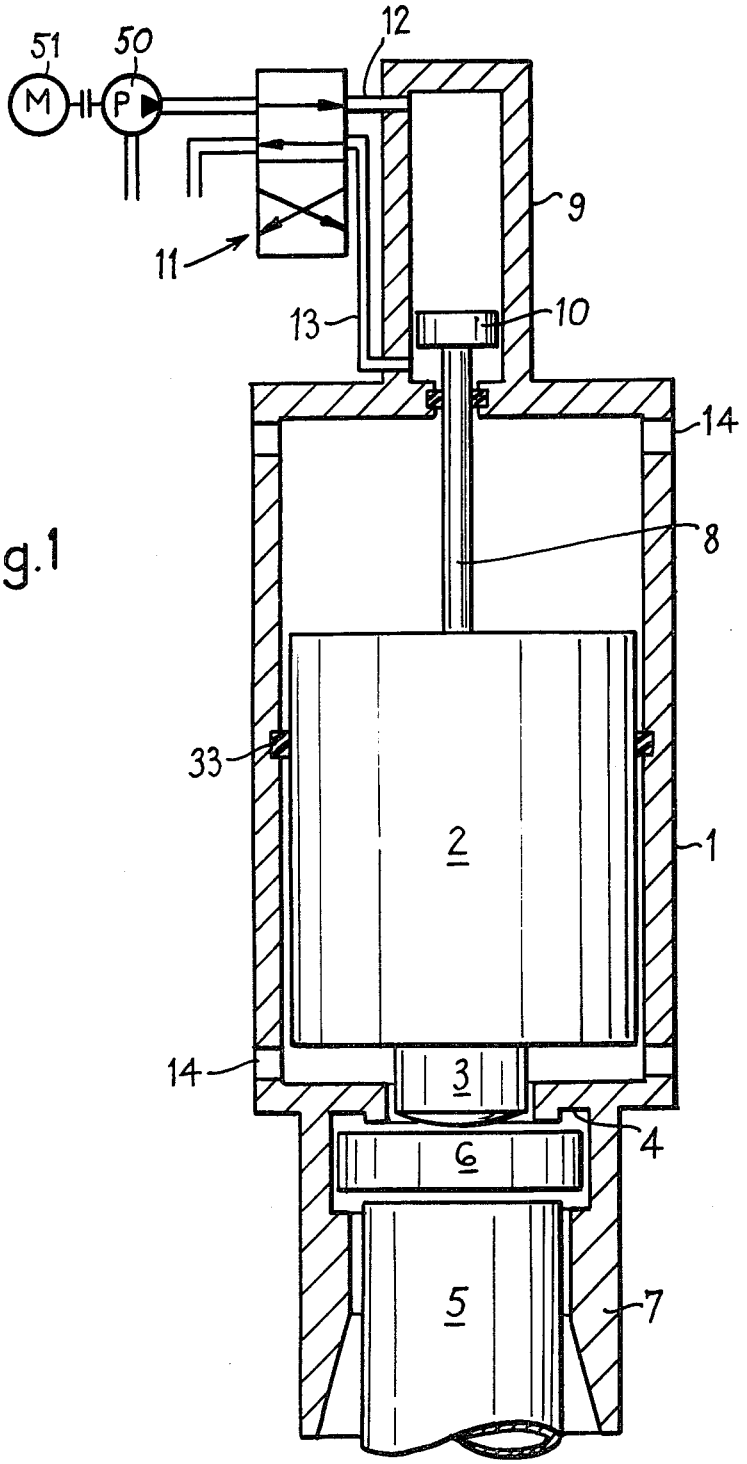
FIG. 1 is a diagrammatic vertical section of one embodiment of pile-driving apparatus constructed in accordance with the invention.

Referring to FIG. 1, the pile driving apparatus comprises a hammer unit having a housing 1 within which a hammer in the form of a ram 2 is mounted for upwards and downwards movement. The ram 2 has a striker member or impact head 3 which projects through an opening in the end plate 4 of the housing to deliver an impact force to a pile 5 through an anvil 6. The anvil 6 is held captive for limited vertical movement within a downwardly extending pile extension or sleeve 7 for guiding the apparatus onto and receiving the top of the pile to be driven.

The ram 2 is connected to a rigid rod 8 which passes through a sealed opening in the upper end of the housing and into a cylinder 9 in which it is connected to a piston 10. Pressurized liquid driving or priming medium is supplied to the cylinder spaces above and below the piston 10 through an automatic reversing valve device 11 and conduits 12 and 13 respectively.

The priming liquid is pressurized by means of a pump 50 driven by a motor 51. The ambient water forms the hydraulic tank of the driving circuit which is pressurized by means of a suitable motor-driven pump 50, 51. The housing 1 has apertures 14 therein, above and below the upper and lower ends respectively of the ram 2 whereby the ambient water can flow into the housing 1 and the ram 2 moves in this liquid. There is no gas in the housing. Optionally, an annular seal 33 projects from the wall of the housing 1 and engages with the hammer body or ram 2.

Figure 2:
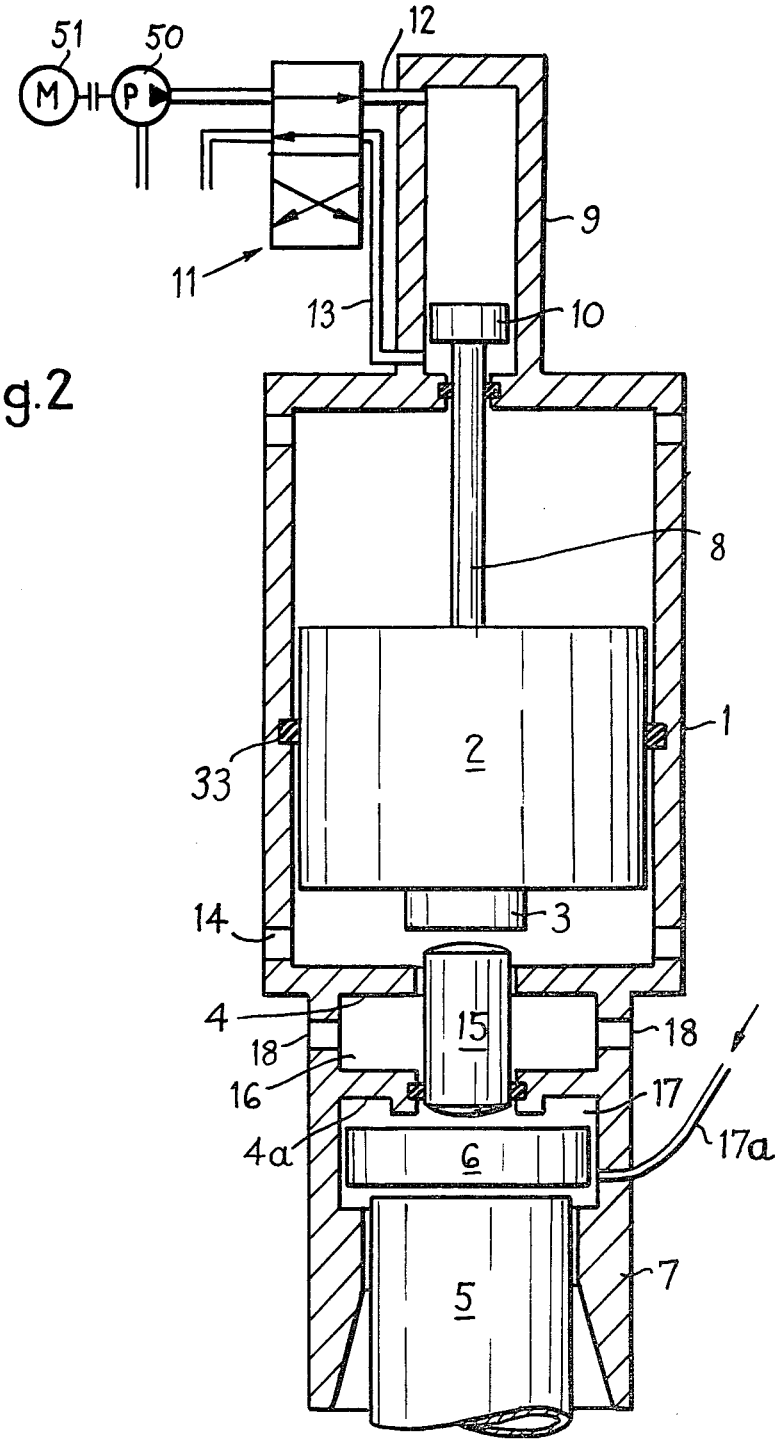
FIGS. 2 to 11 are diagrammatic vertical sections of other embodiments.

In the embodiment shown in FIG. 2, the top of the pile can be kept free from the ambient liquid by means of a member 15 which projects through the aperture in the end plate 4 of the housing, through a chamber 16 and a seal in the opening in the bottom wall 4*a* of the chamber 16 to deliver the impact force from the hammer to the pile anvil. Compressed air or gas is supplied to the anvil chamber 17 through a hose 17*a* from a source, such as a gas cylinder mounted on the hammer unit. The ambient water can enter into the chamber 16 through apertures 18.

Figure 3:
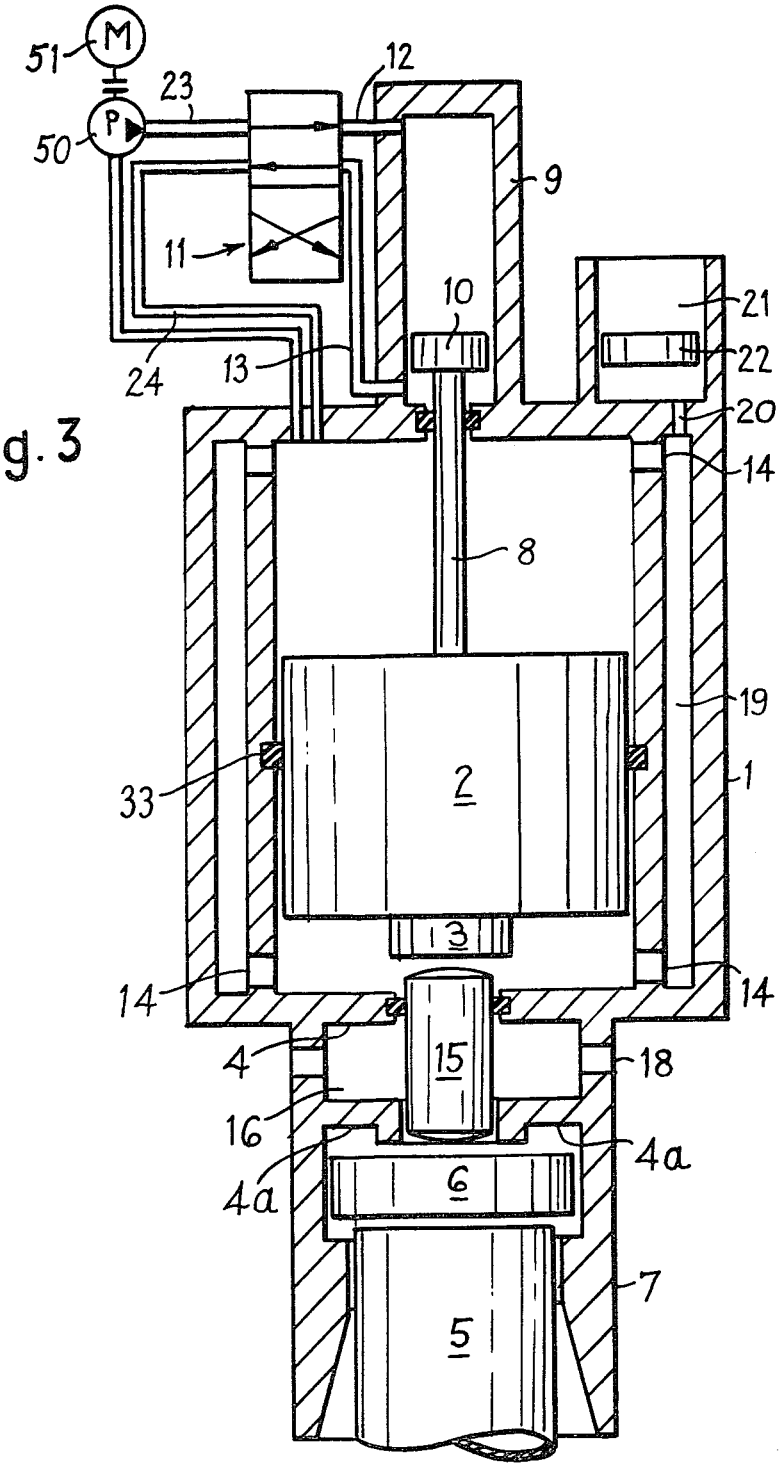

The construction of FIG. 3 is suitable for driving both above and under water. The aperture in the bottom end of the housing 1 is sealed against the member 15 so that it will contain a liquid, such as oil, within the housing and is provided with a pressure and volume equalization or compensation system whereby pressure of the liquid inside the housing, with the ram 2 at rest, can be substantially equal to that of the ambient water or air and to compensate for the changes in volume of the liquid inside the housing above and below the ram. This compensation system comprises an annular chamber 19 in a double wall of the housing 1 and communicating therewith by means of apertures 14 above and below the ram 2. The annular chamber 19 communicates through a passage 20 in the wall of the housing 1 with a chamber 21 containing a piston 22. In the embodiment shown in FIG. 3, the liquid in the housing 1 also constitutes the priming liquid, the housing thus having the double function of also being a tank for the priming liquid. Thus, priming liquid is supplied to the chambers of the cylinder 9 from the interior of the housing through passages 23, 24 via the automatic reversing valve device 11. In this embodiment the priming system is a closed circuit system and can be used for both above and underwater driving.

Figure 4:
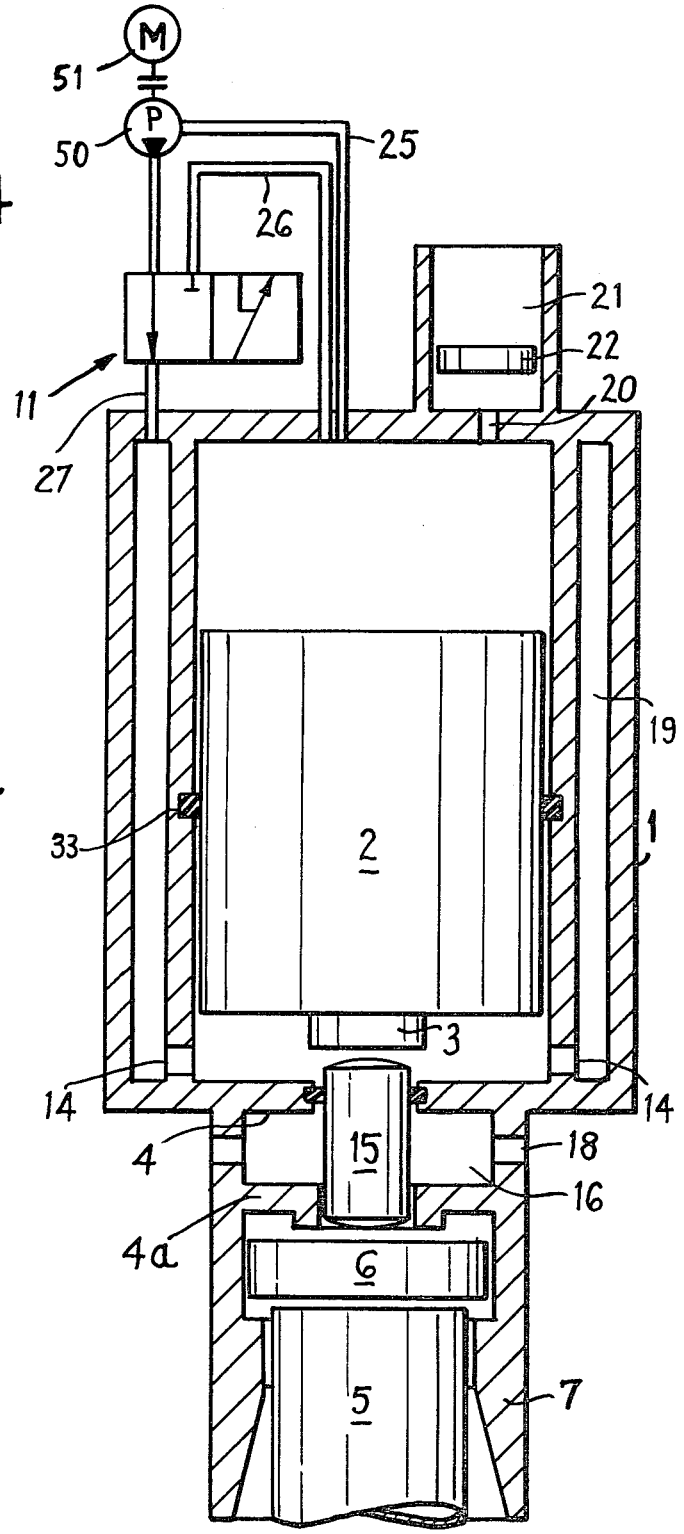
Figure 5:
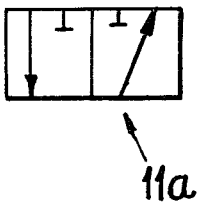

Referring now to FIGS. 4 to 7, which show constructions suitable for above and underwater driving but differing from that of FIG. 3 in that the ram itself is a part of, or forms, the piston of the priming or driving system. Furthermore, the compensation chamber 21 communicates with the interior of the housing which forms the priming liquid supply tank. In FIG. 4, the priming system is of the single-acting type and thus the hammer is in the form of a dropweight 2. Conduits 25, 26 communicate with the space 30*a* in the interior of the housing 1 via the automatic reversing valve 11 or 11*a* (FIG. 5), priming liquid being supplied through the valve via a passage 27, annular chamber 19 and apertures 14 to the undersurface of the dropweight.

Figures 6, 6A:
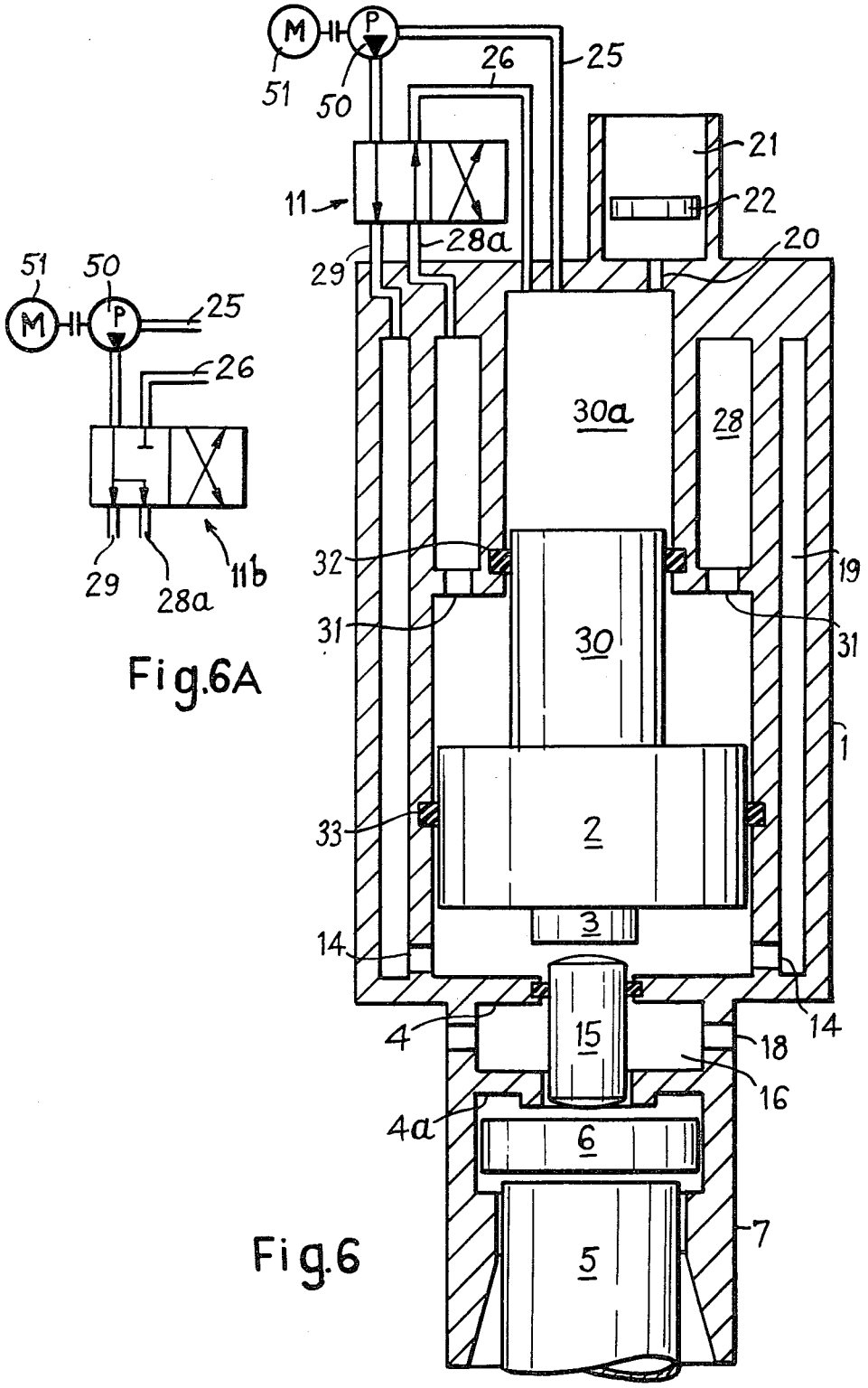
Figure 7:
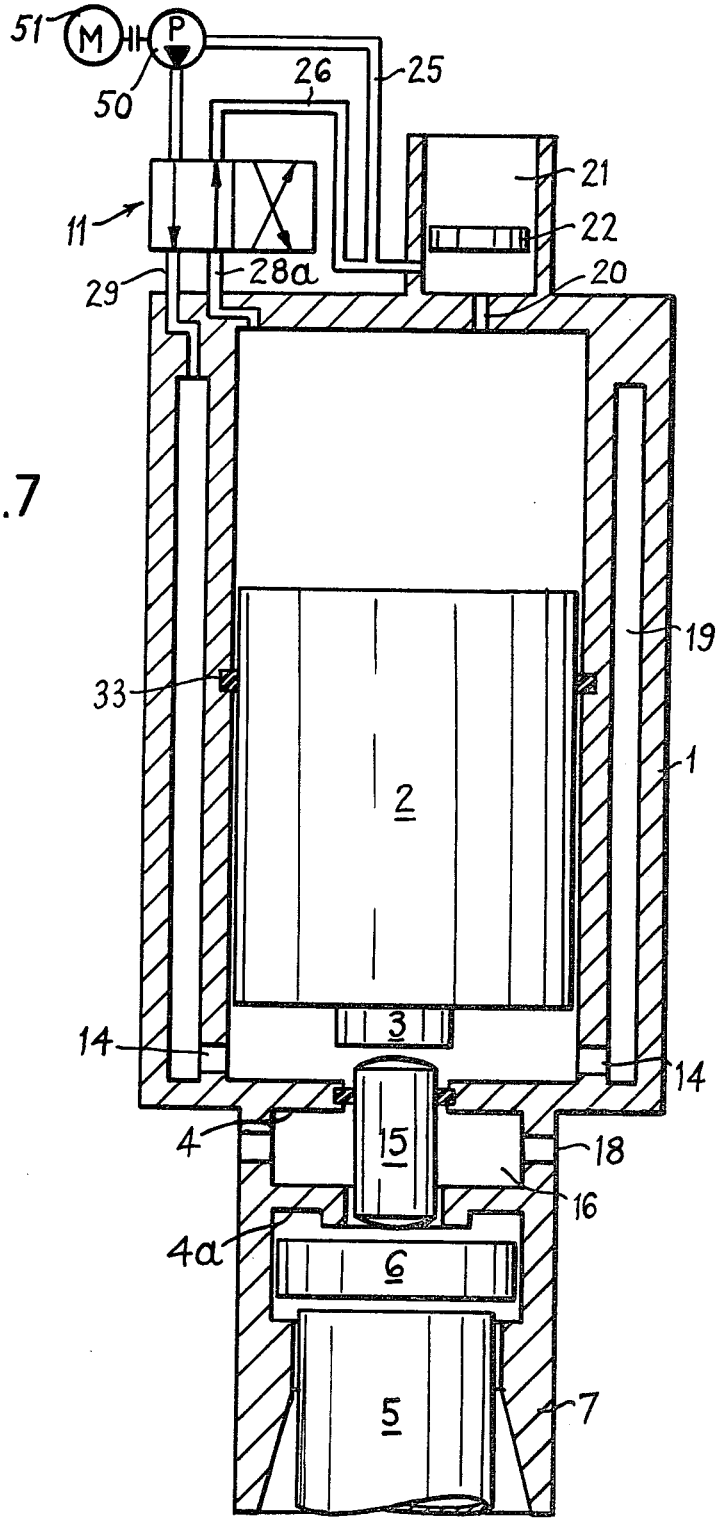

The priming system of FIGS. 6 and 7 is of the double-acting type in which the reversal of the direction ot the ram 2 in its upper position here is mainly caused by the self weight of the ram and partly by the downward force of the priming liquid that works on the ram which consists of an upper part 30 with a lesser diameter than the lower part 2.

Conduits 25 and 26 communicate the valve 11 or 11*b* (FIG. 6A) with the tank space 30*a* in the housing 1 which, in FIG. 6, has an additional annular chamber 28 between the tank space 30*a* and the annular chamber 19 communicating with the reversing valve 11 or 11*b* through a conduit 29. The ram 2 has an upwardly projecting portion 30 of lesser diameter than the main body of the hammer and defining on the upper surface of the body an annular pressure surface of lesser area than that on the under surface of the main body. Apertures 31 in the lower wall of the annular chamber 28 and a conduit 28*a* connecting this chamber to the valve device 11 or 11*a* permits the priming liqid to be supplied to the housing space above the main body of the ram to drive the ram downwards. At its upper end, the ram portion 30 of FIG. 6 projects into the space 30*a* of the housing and an annular seal 32 seals the space above the main body of the ram from the space 30*a*. In FIG. 7 conduit 28*a* communicates with space above the ram 2.

Figure 8:
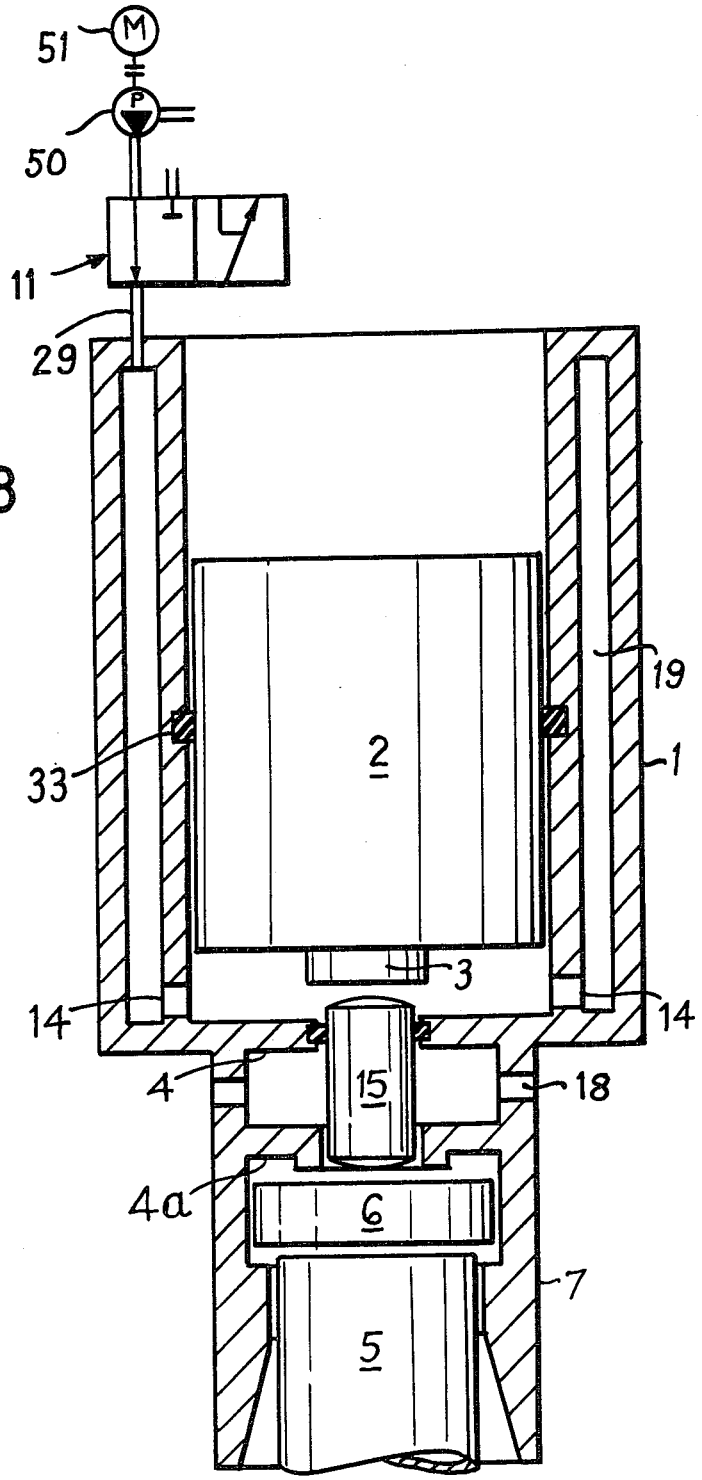
Figure 9:
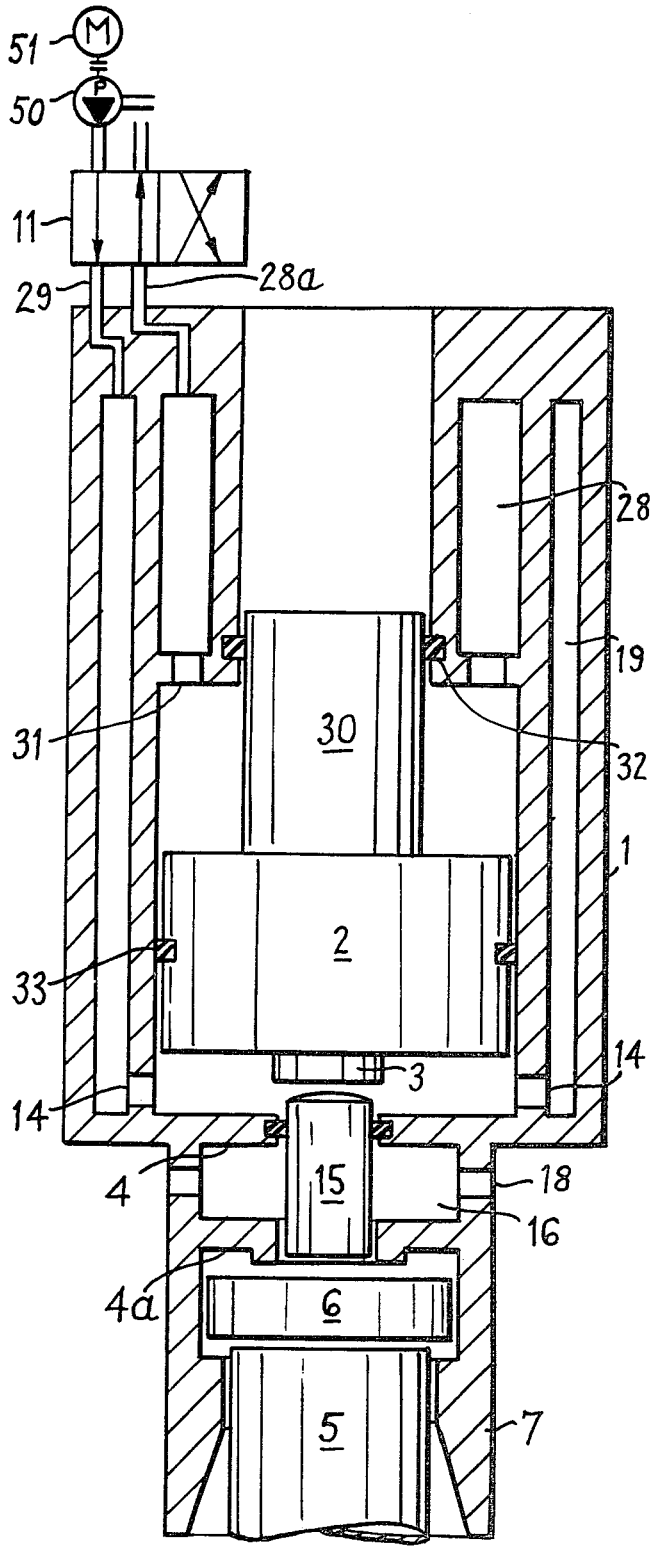

The embodiments of FIGS. 4 to 7 have closed-circuit priming systems, unlike those of FIGS. 8 and 9 in which the housing is open at the top and receives the ambient water in which the apparatus will be submerged in underwater pile driving. Thus, no pressure and volume compensation means are required and the priming liquid is the ambient water.

In all the embodiments herein described, the drive unit or powerpack containing an electric or hydraulic motor and pump may form part of the hammer unit or housing, i.e. it may be mounted in an extension of the housing or in a housing or housing part which is rigidly connected by welding or bolts to the hammer housing 1.

Non-positive displacement pumps, such as centrifugal pumps, may be used to pressurize the priming liquid. The construction of FIGS. 8 and 9 are particularly suitable for centrifugal pumps which do not require the use of fluid accumulators. The powerpack can be positioned in line with the pile driving apparatus providing a long but slender hammer unit such as is illustrated in FIG. 10.

Figure 10:
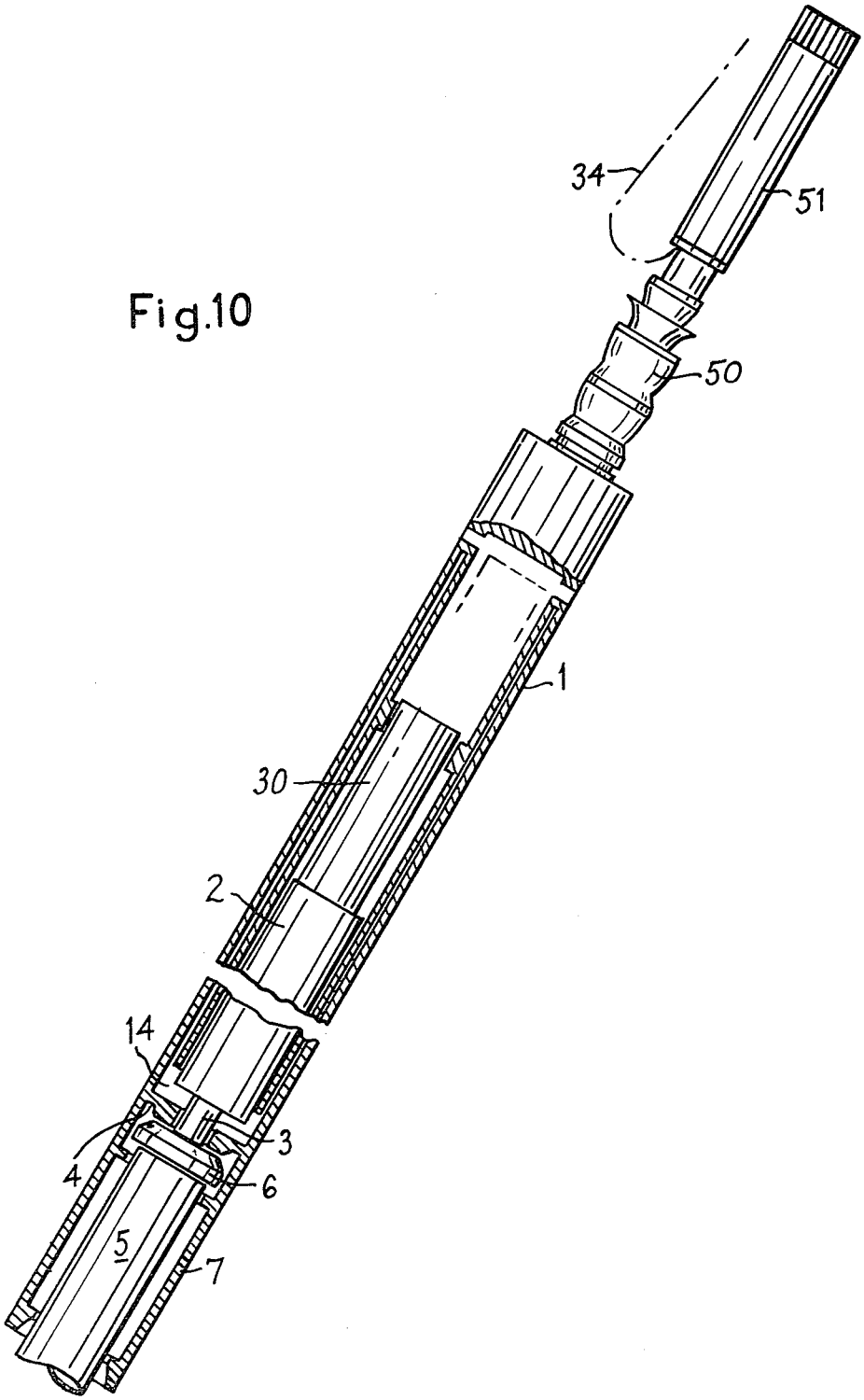

Referring more particularly to FIG. 10, the drive unit or powerpack comprising pump 50 and its motor 51 forms a part of the hammer unit, being rigid with the hammer housing 1. A cable 34 supplies the drive unti with electricity and may be a co-axial cable enabling the supply of compressed air to the area of the pile anvil and pile top. The hammer unit may have a total length of 15.5 meters, a diameter of 0.85 meters and the combined hammer parts 2, 3 and 30 may weigh 16 metric-tons, and deliver a net energy per blow of 30 metric tons.

Figure 11:
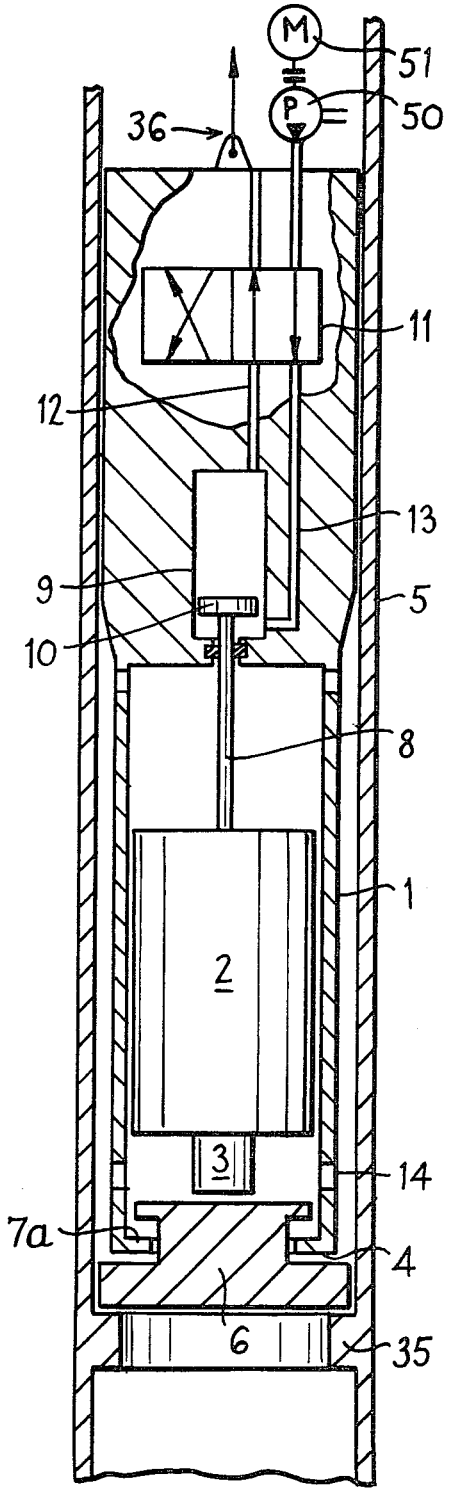

The embodiment shown in FIG. 11 is adapted for insertion inside a hollow pile 5 with the anvil 6 supported in the opening in the bottom end of the housing by means of an annular shoulder *7a*. The impact stroke of the hammer is transmitted via the anvil to an internal ring 35 of the pile 5 or in the case of a closed-ended hollow pile the impact energy of the hammer is directly transferred through the anvil to the bottom plate of the pile (not shown). In the construction of FIG. 11 there are hoist means 36 to lower and to retrieve the hammer unit. Advantageously the drive unit or powerpack containing the pump 50 and its motor 51 and all the conduits are built in to the top part of the hammer unit.

In the embodiments of FIGS. 3 to 9, compressed air may be supplied through the apertures 18 to keep the top of the pile and the anvil free from water.

In all the constructions herein described, the pressure or energy imparted to the priming liquid is just sufficient to overcome the weight of the hammer in order to drive the hammer upwards and the kinetic energy delivered by the hammer comes either wholly (single acting) or for its majority (double-acting) from the potential energy that is accumulated in the heavy hammer. The hammer may be completely solid or comprise a resilient impact transmitting buffer as described in U.S. Pat. No. 3,417,828 in which case the striker member or impact head 3 projects from a piston contained in a chamber within the hammer, the chamber having a pre-compressed gas therein.

The constructions herein described are suitable for driving piles in deep and very deep water, for example 1 or 2 kilometers deep or more.

I claim:

1. Underwater pile driving apparatus comprising a housing having means defining an opening in its bottom end, a motor driven pump producing a pressurized driving liquid, and a hammer movable upwards and downwards in said housing and which is driven in at least the upward direction by said pressurized driving liquid and is arranged to deliver, through said opening, an impact to a pile to be driven, said housing in which the hammer moves being filled, during operation, with the driving liquid which is present both above and below the hammer, the housing enclosing the liquid in which the hammer moves, the pump being in communication with the liquid in the housing through a closed circuit system, and pressure and volume compensating means being provided between the liquid in the housing and the ambient water. whereby the liquid in the housing is maintained substantially at the pressure of the ambient water in which the apparatus is submerged.

2. Apparatus according to claim 1, characterized in that the hammer delivers its impact to a member which is movable in the opening in its bottom end and transmits the impact to the pile.

3. Apparatus according to 2, characterized in that sealing means is provided for preventing leakage between said opening and said member movable therein, and the hammer forms a drive piston which is driven by said driving liquid.

4. Apparatus according to claim 3, characterized in that the hammer has a main body part acting as the said drive piston and an upper part which is of lesser diameter than the main body part, the housing having liquid filled spaces above and below the main body part, the upper part of the hammer projecting into a housing space which forms a reservoir for the driving liquid and which is sealed from the liquid filled space above the main body part and the upper part of the hammer defining on the upper surface of the main body part of the hammer a pressure surface of lesser area than that on the undersurface thereof, and in that reversing valve means is in communication with the liquid in the housing space and is connected to said liquid filled spaces above and below the main body part of the hammer.

5. Apparatus according to claim 1, characterized in that said pump is a rotary pump and is located on said housing.

6. Underwater pile driving apparatus comprising a housing having means defining an opening in its bottom end, a motor driven pump producing a pressurized driving liquid, and a hammer movable upwards and downwards in said housing and which is driven in at least the upward direction by said pressurized driving liquid and is arranged to deliver, through said opening, an impact to a pile to be driven, said housing in which the hammer moves being filled, during operation, with the driving liquid which is present both above and below the hammer, and means is provided for maintaining the liquid in the housing substantially at the pressure of the ambient water in which the apparatus is submerged, the said ambient water constituting the source of supply for the driving liquid.

7. Apparatus according to claim 6, characterized in that the housing has apertures therein through which the ambient water in which the apparatus is submerged enters freely into the housing, above and below the hammer.

8. Apparatus according to claim 6, characterized in that said pump is a centrifugal pump.

* * * * *

UNITED STATES PATENT AND TRADEMARK OFFICE

CERTIFICATE OF CORRECTION

PATENT NO. : 4,367,800

DATED : January 11, 1983

INVENTOR(S) : Dirk Arentsen

It is certified that error appears in the above-identified patent and that said Letters Patent is hereby corrected as shown below:

ON THE TITLE PAGE INSERT,

-- [30] Foreign Application Priority Data:

Feb. 27, 1979 [GB] United Kingdom....06930/79 --.

Signed and Sealed this

First Day of March 1983

[SEAL]

*Attest:*

GERALD J. MOSSINGHOFF

*Attesting Officer*

*Commissioner of Patents and Trademarks*